US007771147B2

(12) United States Patent
Bederke

(10) Patent No.: US 7,771,147 B2
(45) Date of Patent: Aug. 10, 2010

(54) COUPLING PART FOR CONNECTING TWO CONTAINERS STACKED ON TOP OF ONE ANOTHER

(75) Inventor: Christian Bederke, Bremen (DE)

(73) Assignee: SEC Ship's Equipment Centre Bremen GmbH, Bremen (DE)

( * ) Notice: Subject to any disclaimer, the term of this patent is extended or adjusted under 35 U.S.C. 154(b) by 311 days.

(21) Appl. No.: 11/574,037

(22) PCT Filed: Aug. 25, 2005

(86) PCT No.: PCT/EP2005/054191

§ 371 (c)(1),
(2), (4) Date: Feb. 21, 2007

(87) PCT Pub. No.: WO2006/021579

PCT Pub. Date: Mar. 2, 2006

(65) Prior Publication Data

US 2009/0095763 A1 Apr. 16, 2009

(30) Foreign Application Priority Data

Aug. 26, 2004 (DE) ..... 20 2004 013 463 U

(51) Int. Cl.
*B60P 7/06* (2006.01)
*B65D 90/00* (2006.01)

(52) U.S. Cl. ..... 410/78

(58) Field of Classification Search ..... 410/71, 410/73, 76, 77, 82, 83, 78; 220/23.4; 403/321, 403/325, 335, 374.5, 385; 24/287, 288, 595.1, 24/602, 605–608, 611, 697.1, 698.1, 580.1, 24/DIG. 53–59

See application file for complete search history.

(56) References Cited

U.S. PATENT DOCUMENTS

| | | | | |
|---|---|---|---|---|
| 3,442,480 | A * | 5/1969 | Marvin et al. | 410/76 |
| 3,685,778 | A * | 8/1972 | Berns | 410/116 |
| 3,894,493 | A * | 7/1975 | Strecker | 24/287 |
| 4,082,052 | A * | 4/1978 | Looks | 410/82 |
| 4,277,212 | A * | 7/1981 | Rosaia | 410/78 |
| 5,297,498 | A * | 3/1994 | Donner | 114/75 |
| 6,334,241 | B1 * | 1/2002 | Flodin | 24/287 |
| 6,336,765 | B1 * | 1/2002 | Watanabe | 403/325 |
| 7,231,695 | B2 * | 6/2007 | Park | 24/287 |
| 7,484,918 | B2 * | 2/2009 | Brewster | 410/69 |
| 7,510,358 | B2 * | 3/2009 | Brewster | 410/69 |

FOREIGN PATENT DOCUMENTS

| | | |
|---|---|---|
| DE | 199 05 909 A1 | 8/2000 |
| DE | 102 38 895 A1 | 3/2004 |
| EP | 0832827 A2 | 4/1998 |

* cited by examiner

*Primary Examiner*—H Gutman
(74) *Attorney, Agent, or Firm*—McGlew and Tuttle, P.C.

(57) ABSTRACT

A coupling part (10) is provided for connecting two containers stacked on top of one another, in particular on board ships, at their corner fittings (13). The coupling part (10) includes two coupling projections (11, 12) facing in opposite directions. One projection (11) engages in the corner fitting (13) of one container and the other projection (12) engages in the corner fitting of the other container. It is ensured that the coupling part (10) can be mounted in the corresponding corner fitting such that locking lugs (18) of the coupling part (10) always face in the same direction on an end face of the container, i.e. that no coupling part (10) is inadvertently inserted the wrong way. One of the coupling projections (11) of the coupling part (10) is asymmetrical. The coupling part (10) can only be inserted into and mounted on the corner fitting (13) in a specific direction.

19 Claims, 3 Drawing Sheets

COUPLING PART FOR CONNECTING TWO CONTAINERS STACKED ON TOP OF ONE ANOTHER

CROSS REFERENCE TO RELATED APPLICATIONS

This application is a United States National Phase application of International Application PCT/EP2005/054191 and claims the benefit of priority under 35 U.S.C. §119 of German Patent Application DE 20 2004 013 463.2 filed Aug. 26, 2004, the entire contents of which are incorporated herein by reference.

FIELD OF THE INVENTION

The present invention pertains to a coupling piece for connecting two containers stacked one on top of another, especially on board ships, at the corner fittings thereof with two coupling projections, which are directed away from each other and of which one coupling projection meshes with the corner fitting of one container and the other coupling projection meshes with the corner fitting of the other container.

BACKGROUND OF THE INVENTION

Such a coupling piece is known from DE 102 38 895 A1. When loading containers on board ships, the containers are first raised with a spreader on the pier and the corner fittings are then hung into the lower corner fittings of the raised container. The container is subsequently lifted on board and deposited there on a container already standing on deck. The coupling pieces now interlock with the upper corner fittings of the lower container. The container is now secured against slipping and being lifted off; however, it may be additionally secured by means of lock rods.

The coupling piece shown in DE 102 38 895 A1 has a locking lug directly to the side at the lower coupling projection. One problem with this coupling piece is that it can be inserted in two different orientations, namely rotated by wherein about the vertical axis. It is therefore explained in the document that it is very important that the locking lug of the coupling pieces located on one front side of the container point in the same direction to make it possible to satisfactorily unlock and lock the container. It is possible that all four locking lugs point in the same direction or the locking lugs on one front side point in one direction and the locking lugs on the other front side in the other direction. As was mentioned, the only thing that is important is that the locking lugs on one front side always point in the same direction. Reference is made in this respect to DE 102 38 895 A1.

Securing means that prevent the coupling pieces from being inserted such that the locking lugs on one side point in different directions are not shown in DE 102 38 895 A1. Correct insertion of the coupling pieces is rather made the responsibility of the stevedore. Thus, incorrect operation due to human failure is not ruled out.

SUMMARY OF THE INVENTION

Based on this, the basic object of the present invention is to perfect a coupling piece of the type mentioned in the introduction such that the locking lugs on one front side of the container always point in the same direction, i.e., no coupling piece can be accidentally inserted the wrong way around.

To accomplish this object, the coupling piece according to the present invention is characterized in that an asymmetry is provided at one of the coupling projections, such that the coupling piece can be inserted into the corner fitting in a certain orientation only.

The present invention takes advantage of the circumstance that the elongated hole on the corner fitting, into which the coupling piece with one of its coupling projections is inserted, is placed asymmetrically in the corner fitting, because the elongated hole is not arranged exactly centrally in the corner fitting but diagonally towards the container. It is ensured due to the asymmetry at the coupling projection that the coupling piece can be inserted in a certain orientation only. Insertion in another orientation, rotated by 180°, is no longer possible.

It is most meaningful for the asymmetry to be arranged at the coupling projection that first is inserted into one of the containers. In practice, this is the coupling projection that meshes with the lower corner fitting of the upper container. Incorrect insertion of the coupling piece is thus avoided from the very beginning.

A spacer, for example, a gudgeon, is provided at the coupling projection in question in one design embodiment of the present invention.

The spacer (the gudgeon) is preferably arranged on one front side of the coupling projection, i.e., in the direction of the central longitudinal axis of the container. Even though it is also conceivable to arrange the spacer laterally, this variant would require the provision of two separate coupling pieces for the left side and the right side, i.e., the left and right corner fittings, because the spacer must always point towards the outside.

To make it possible to arrange additional locking means at the corner fittings, the asymmetry should be arranged correspondingly. This is achieved in practice by the asymmetry not having an overlap with an eye on the corner fitting. In other words, the asymmetry is arranged offset in relation to the eye in the corner fitting.

The present invention will be explained in greater detail below on the basis of exemplary embodiments shown in the drawings. The various features of novelty which characterize the invention are pointed out with particularity in the claims annexed to and forming a part of this disclosure. For a better understanding of the invention, its operating advantages and specific objects attained by its uses, reference is made to the accompanying drawings and descriptive matter in which preferred embodiments of the invention are illustrated.

DESCRIPTION OF THE PREFERRED EMBODIMENTS

Figure 7:
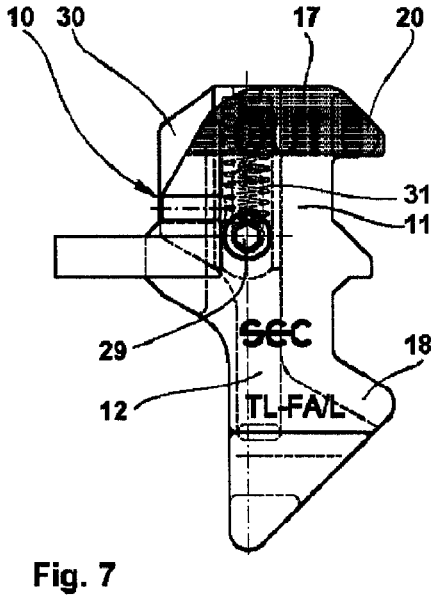
FIG. 7 is a front view of the coupling piece according to FIG. 6.
Figure 6:
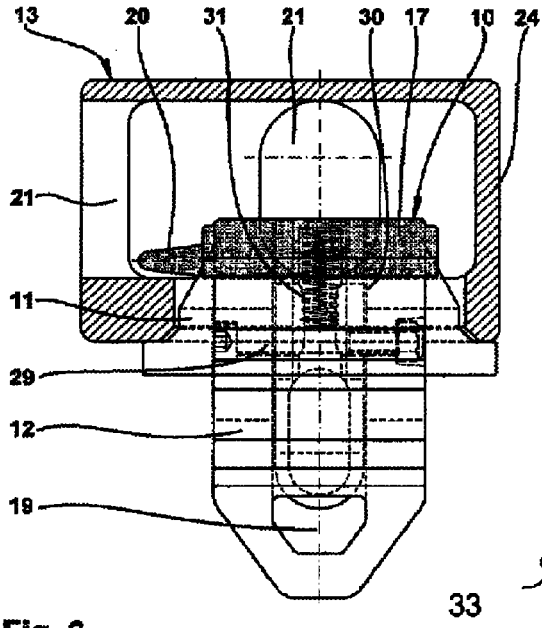
Figure 7:
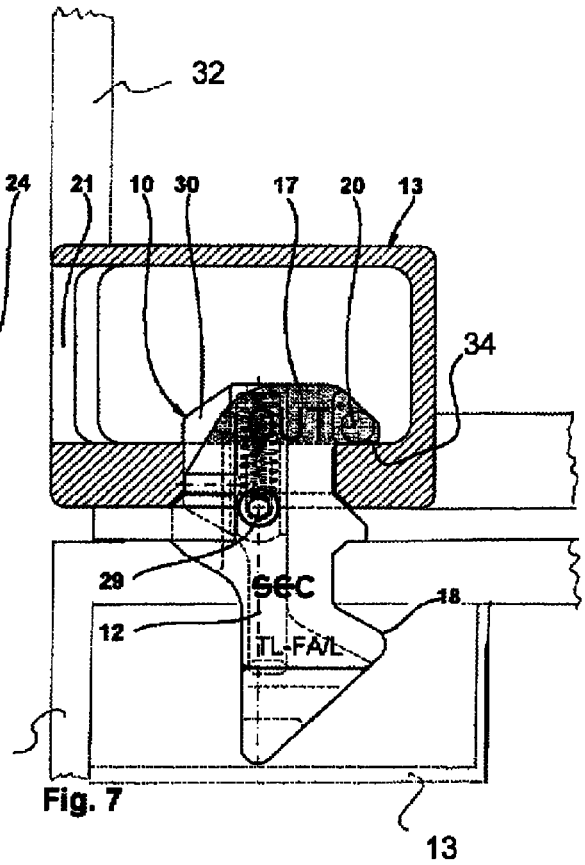
Figure 8:
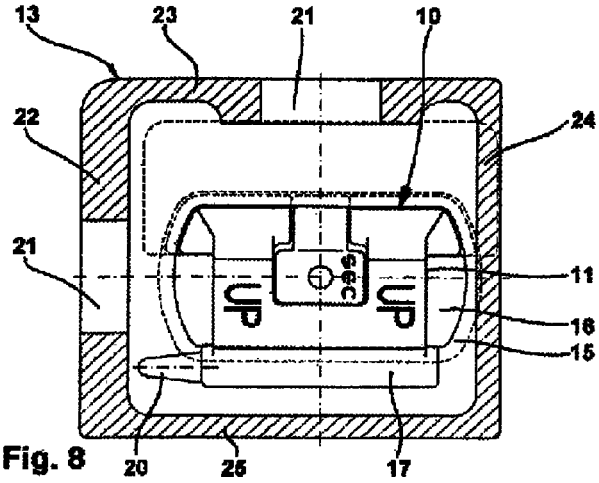
FIG. 8 is a top view of a corner fitting with an inserted coupling piece having the features according to the embodiment of FIG. 6.

Referring to the drawings in particular, the coupling piece 10 shown has a first coupling projection 11 and a second coupling projection 12 directed away from the first coupling projection 11. The first coupling projection 11 is usually inserted into the lower corner fitting 13 of an upper container 32, see FIG. 7. This coupling projection 11 is therefore also often called the upper coupling projection 11. When the upper container 32 is deposited on a lower container 33 in the stack of containers, the other coupling projection 12 always meshes with the upper corner fitting of the lower container 33 and thus locks the two containers 32, 33 with one another. The other coupling projection 12 is also called the lower coupling projection 12. However, it would, of course, also be possible to use the coupling piece 10 the other way around, i.e., in an overhead arrangement (directly on board).

Figure 2:
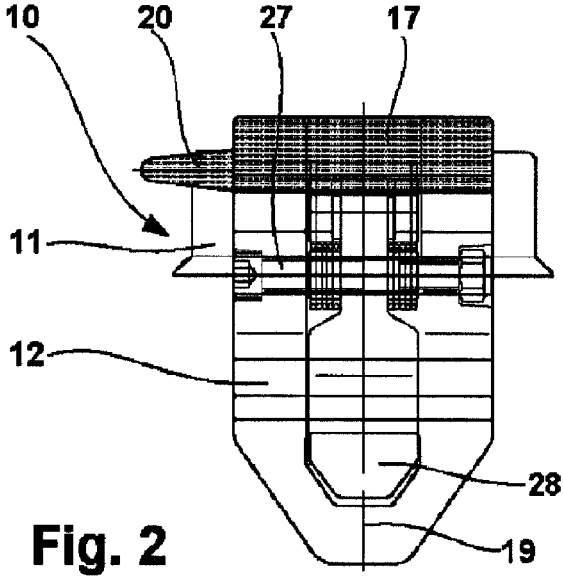
FIG. 2 is a side view of the coupling piece according to FIG. 1.
Figure 3:
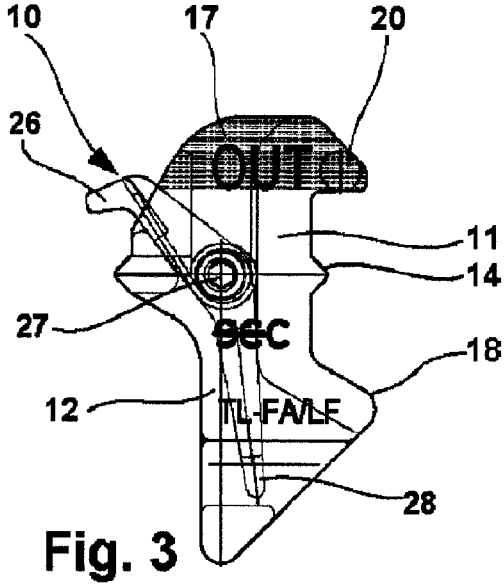
FIG. 3 is a front view of the coupling piece according to FIG. 1.

As can be clearly recognized from FIG. 2 and FIG. 3, a bead 14 is provided at the transition between the upper coupling projection 11 and the lower coupling projection 12. The vertical position of the coupling piece 10 is fixed by means of the bead 14 between the corner fittings 13, by the bead 14 meshing with a groove formed by a chamfer 15 at an elongated hole 16 of each corner fitting 13.

When the coupling piece 10 is inserted into the corner fitting 13 of the upper container 32, the upper coupling projection 11 is introduced into the elongated hole 16 of this corner fitting 13. A projection 17 at the upper coupling projection 11 has a lip 34 that then reaches behind the elongated hole 16, so that the coupling piece 10 no longer drops out. Like the coupling piece shown in DE 102 38 895 A1, the coupling piece 10 has, at the lower coupling projection 12, a locking lug 18 pointing laterally in relation to the longitudinal extension of the elongated hole 16. When the upper container is deposited on the lower container 33, the lower coupling projection 12 slides into the elongated hole of the upper corner fitting of the lower container in the same manner as in the coupling piece described in DE 102 38 895 A1, and the locking lug 18 reaches behind the elongated hole of the upper corner fitting.

It would be possible with the coupling piece 10 described so far to insert the coupling piece into the corner fitting 13 in two different orientations, namely, positions rotated from each other about a vertical longitudinal axis 19 of the coupling piece 10. To prevent this, the upper coupling projection 11 is provided with an asymmetry. In particular, a spacer, namely, a gudgeon 20, is made integrally in one piece with the upper coupling projection 11, namely, on a front side of the projection 17. As can be recognized from FIG. 1, the elongated hole 16 is arranged eccentrically in the corner fitting 13. The elongated hole 16 has a greater distance from the free walls 22, 23 provided with eyes 21 than from the other walls 24, 25 pointing towards the container 32. The elongated hole 16 is consequently offset diagonally towards the container 32 in relation to the center of the corner fitting 13. The length of the gudgeon 20 is selected to be such that it fits into the space between the front side of the projection 17 and the wall 22, but it does not fit the space that would be formed between the front side of the projection 17 and the opposite wall 24 in case of orientation rotated about the longitudinal axis 19. The gudgeon 20 would be too long for this.

Figure 1:
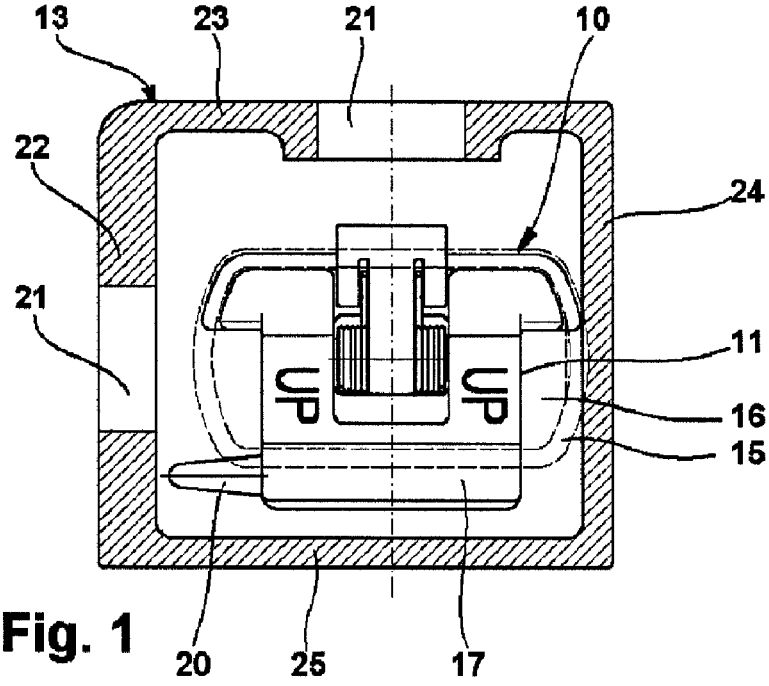
FIG. 1 is a top view of a corner fitting with an inserted coupling piece with the features according to the first exemplary embodiment of the present invention.
Figure 4:
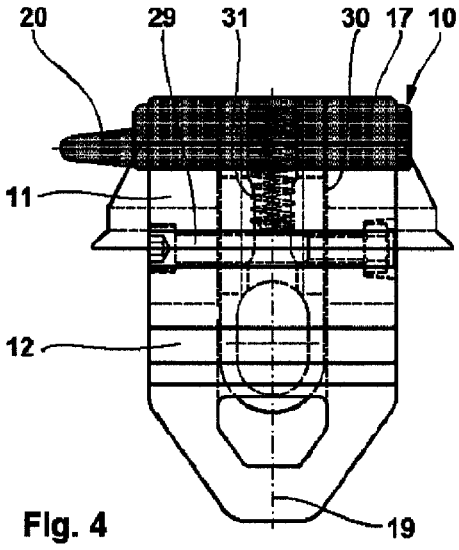
FIG. 4 is a side view of a second exemplary embodiment of a coupling piece with the features of the present invention.

As can be determined from FIG. 1, the gudgeon 20 is positioned such that it is not aligned with the eye 21 in the wall 22 of the corner fitting 13. The gudgeon 20 is consequently positioned in the wall 22 offset in relation to the eye 21. As a result, the eye 21 remains free for arranging additional locking means, especially the hooking fitting of a lock rod.

Furthermore, FIG. 3 shows a securing means, namely, a lever 26, which secured the coupling piece 10 against falling out while the coupling piece 10 is hanging during transport from the pier to the ship or vice versa (heaving). As soon as the upper container 32 is interlocked with the lower container 33 on board ship, this lever 26 is out of action. Consequently, the lever 26 is not involved in the locking operation per se.

The lever 26 is designed as a two-armed lever and is mounted by means of a hinge 27. An operating lever 28 is used for releasing the coupling piece 10 by the stevedore when the coupling piece is removed after unloading the container.

Figure 5:
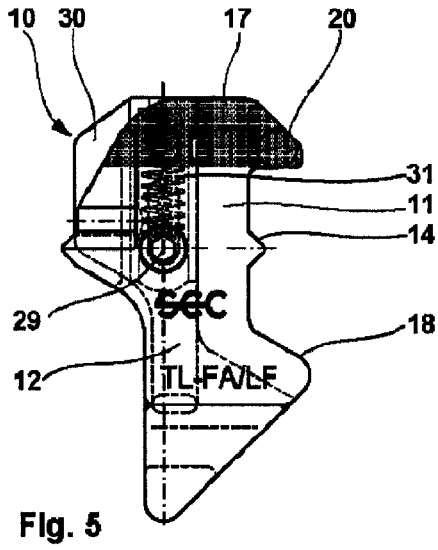
FIG. 5 is a front view of the coupling piece according to FIG. 4.
Figure 6:
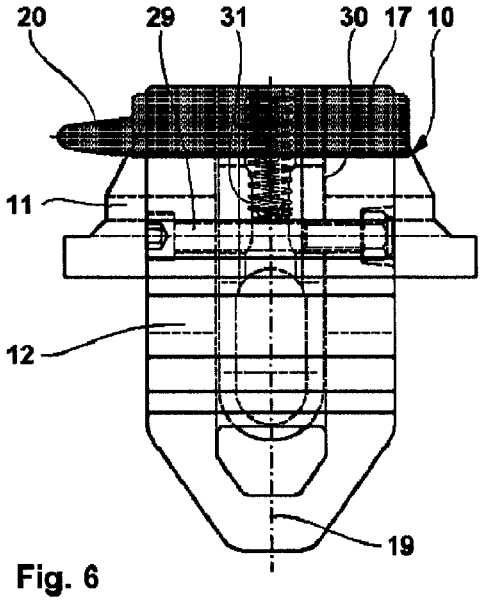
FIG. 6 is a side view of another exemplary embodiment of a coupling piece with the features of the present invention.

The securing means is a block 30 mounted pivotably by means of a hinge 29. In the securing position shown in FIGS. 4 through 7, this block 30 is pretensioned by means of a compression spring 31 and can be pivoted against the force of the compression spring 31 inwardly (clockwise in FIGS. 5 and 7), so that the coupling piece 10 can be inserted or removed from the corner fitting. The force of the compression spring 31 is selected in this case to be such that it prevents unintentional dropping out, but makes it possible for the coupling piece to be removed by the stevedore.

In addition or as an alternative, the gudgeon 20 may also be arranged laterally at the upper coupling projection 11, so that the gudgeon 20 fits into the space between the upper coupling projection 11 and the wall 23. The length of the gudgeon 20 would now to be selected again to be such that it would be too long for an orientation rotated by 180° about the longitudinal axis 19. However, this variant is less preferred, because the elongated hole 16 is always offset towards the center of the container. A lateral gudgeon would therefore require two different coupling pieces for left and right.

While specific embodiments of the invention have been shown and described in detail to illustrate the application of the principles of the invention, it will be understood that the invention may be embodied otherwise without departing from such principles.

The invention claimed is:

1. A coupling piece for connecting, two containers stacked one on top of another, at corner fittings thereof, the coupling piece comprising:

a first coupling projection;

a second coupling projection, said first coupling projection and said second coupling projection being directed away from each other, one of said first coupling projection and said second coupling projection engaging with the corner fitting of one of the two containers and the other of said first coupling projection and said second coupling projection engaging with the corner fitting of another of the two containers;

a separate spacer provided at one of said first coupling projection and said second coupling projection limiting a direction of insertion of said one of said first coupling projection and said second coupling projection whereby the coupling piece can only be inserted into the corner fitting in a single orientation.

2. A coupling piece according to claim 1, wherein said separate spacer is a gudgeon.

3. A coupling piece in accordance with claim 1, wherein said separate spacer is arranged at said first coupling projection and said first coupling projection is inserted first into the corner fitting of the one container before the one container is placed on the another container.

4. A coupling piece in accordance with claim 1, wherein one of said first coupling projection and said second coupling projection has a projection portion and said separate spacer is provided at said projection portion.

5. A coupling piece in accordance with claim 1, wherein said separate spacer is arranged on a front side of one of said first coupling projection and said second coupling projection.

6. A coupling piece in accordance with claim 1, wherein said separate spacer is arranged such that additional locking means can be engaged with one of the corner fittings.

7. A coupling piece in accordance with claim 6, wherein the separate spacer has no overlap with an eye at the corner fitting.

8. A two container coupling system, comprising:

a first container with a corner fitting;

a second container with a corner fitting, said first container and said second container for stacking one on top of another;

a first coupling projection for engaging with the corner fitting of said first container or said second container in one of a first and second orientation;

a second coupling projection for engaging the corner fitting of said first container or said second container, said first coupling projection and said second coupling projection being directed away from each other;

a separate spacer connected to said first coupling projection for preventing insertion of said first coupling projection into said corner fitting of said first container or into said corner fitting of said second container in said first orientation and allowing insertion of said first coupling projection into said corner fitting of said first container or into said corner fitting of said second container in said second orientation.

9. A system in accordance with claim 8, wherein said first coupling projection is inserted first into one of the corner fittings before the first container is placed on the second container.

10. A system in accordance with claim 8, wherein said first coupling projection has a projection portion and said spacer is provided at said projection portion.

11. A system in accordance with claim 8, wherein said spacer is arranged on a front side of said first coupling projection.

12. A system in accordance with claim 8, wherein said separate spacer is arranged such that additional locking means can be engaged with the one corner fitting.

13. A coupling piece for connecting two containers stacked one on top of another, each of the containers having a corner fitting defining a hole, the coupling piece comprising:

a bead section having first and second sides, said first and second sides being arranged on diametrically opposite sides of said bead section;

a first coupling projection arranged on said first side of said bead section for engaging with the hole in the corner fitting of the first container, said first coupling projection and the hole being shaped for said first coupling projection to fit into the hole in two different orientations of said first coupling projection with respect to the respective corner fitting;

a second coupling projection arranged on said second side of said bead section for engaging with the hole of the corner fitting of the second container, said first coupling projection and said second coupling projection being directed away from each other, said second coupling projection and the respective hole being shaped for said second coupling projection to fit into the respective hole;

a separate spacer connected to said first coupling projection, said spacer having a shape blocking insertion of said first coupling projection into the respective hole of the respective corner fitting in a first of said two different orientations, said shape of said spacer allowing insertion of said first coupling projection into the respective hole of the respective corner fitting in a second of said two different orientations.

14. A coupling piece in accordance with claim 13, wherein:

said first coupling projection extends from said bead section in a longitudinal direction, said first coupling projection including a lip extending perpendicular to said longitudinal direction to reach behind the respective corner fitting when said first coupling projection is inserted into the respective corner fitting;

said spacer extends from said lip in a direction perpendicular to said longitudinal direction and said lip.

15. A coupling piece in accordance with claim 13, wherein:

each of the corner fittings also define an eye, the eye being in a plane extending from a plane of the respective hole of the corner fitting, the eyes of each of the corner fittings accepting additional locking means;

said spacer being arranged laterally offset from the eye when said first coupling projection is arranged in the respective corner fitting.

16. A coupling piece in accordance with claim 13, wherein:

the hole has an elongated shape;

said spacer is attached to said first coupling projection, and is a separate structure from said first coupling projection.

17. A coupling piece according to claim 13, wherein said spacer is a gudgeon and is a separate structure from said first coupling projection.

18. A coupling piece in accordance with claim 13, wherein said first coupling projection is inserted first into the corner fitting of a first of the two containers before the first of the containers is placed on a second of the two containers.

19. A coupling piece in accordance with claim 13, wherein said spacer is arranged such that additional locking means can be engaged with one of the corner fittings.

* * * * *